US012385370B2

(12) United States Patent
Rogers et al.

(10) Patent No.: US 12,385,370 B2
(45) Date of Patent: Aug. 12, 2025

(54) PLUNGER LIFT WITH A VARIABLE FLOW MECHANISM

(71) Applicant: Endurance Lift Solutions, LLC, Gainesville, TX (US)

(72) Inventors: Jack Rogers, Kemah, TX (US); Travis Bayer, Conroe, TX (US); Ryan Gernentz, Stanton, TX (US)

(73) Assignee: Endurance Lift Solutions, LLC, Gainesville, TX (US)

( * ) Notice: Subject to any disclaimer, the term of this patent is extended or adjusted under 35 U.S.C. 154(b) by 0 days.

(21) Appl. No.: 18/377,847

(22) Filed: Oct. 9, 2023

(65) Prior Publication Data

US 2024/0117720 A1 Apr. 11, 2024

Related U.S. Application Data

(60) Provisional application No. 63/414,319, filed on Oct. 7, 2022.

(51) Int. Cl.
*E21B 43/12* (2006.01)

(52) U.S. Cl.
CPC ..... *E21B 43/121* (2013.01)

(58) Field of Classification Search
CPC ..... E21B 43/121
See application file for complete search history.

(56) References Cited

U.S. PATENT DOCUMENTS

| | | | | |
|---|---|---|---|---|
| 7,513,301 | B2 * | 4/2009 | Victor | E21B 43/121 166/105 |
| 8,464,798 | B2 * | 6/2013 | Nadkrynechny | E21B 43/121 166/105 |
| 9,915,133 | B2 * | 3/2018 | Boyd | E21B 43/121 |
| 10,669,824 | B2 * | 6/2020 | Boyd | E21B 43/121 |
| 2004/0035571 | A1 | 2/2004 | Abbott et al. | |
| 2005/0241819 | A1 | 11/2005 | Victor | |
| 2006/0124294 | A1 | 6/2006 | Victor | |
| 2007/0151738 | A1 | 7/2007 | Giacomino | |
| 2018/0334890 | A1 | 11/2018 | Stadler et al. | |
| 2023/0034975 | A1 * | 2/2023 | Prill | E21B 47/017 |

OTHER PUBLICATIONS

PCT/US2023/034714; "International Search Report and Written Opinion"; mailed Feb. 23, 2024; 12 pages.

* cited by examiner

*Primary Examiner* — Nicole Coy
*Assistant Examiner* — Yanick A Akaragwe
(74) *Attorney, Agent, or Firm* — Hall Estill Law Firm

(57) ABSTRACT

A plunger for use in an oil or gas well that includes a mandrel and a hollow body with radial directed ports disposed therein. The plunger also includes a variable flow mechanism that can be adjusted to achieve a desired fall rate for the plunger for a particular oil and gas operation. A method of lifting fluids from an oil and gas well using the plunger includes the step of employing an adjustable plunger to lift fluids from the oil and gas well wherein the adjustable plunger has a desired fall rate in the well.

9 Claims, 6 Drawing Sheets

PLUNGER LIFT WITH A VARIABLE FLOW MECHANISM

CROSS-REFERENCE TO RELATED APPLICATIONS

The present application is a conversion of U.S. Provisional Application having U.S. Ser. No. 63/414,319, filed Oct. 7, 2022, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a variable flow plunger with a variable flow mechanism that is adjustable to permit the amount of fluid bypass through the plunger for the particular well conditions.

2. Description of the Related Art

Current plungers for oil and gas wells are limited to certain configurations based on how each plunger is manufactured. Each oil or gas well employing a plunger has a desired rate for the plunger to fall in the well. The rate at which a particular plunger falls is dependent on the ability of fluid to flow through the plunger as it falls in the well, among other things. Thus, a number of plunger configurations need to be tried to determine which particular plunger is desirous for a particular well. This causes the need to have numerous variations of plungers on hand, which is fairly inefficient.

Accordingly, there is a need for a plunger with a variable flow mechanism that can be adjusted to achieve the desired fall rate for the plunger for a particular oil or gas well.

SUMMARY OF THE DISCLOSURE

The present disclosure is directed to a plunger for use in an oil or gas well. The plunger includes a mandrel and a hollow body with radial directed ports disposed therein. The plunger also includes a variable flow mechanism that can be adjusted to achieve a desired fall rate for the plunger for a particular oil and gas operation.

The present disclosure is also directed to a method of lifting fluids from an oil and gas well. The method includes the step of employing an adjustable plunger to lift fluids from the oil and gas well wherein the adjustable plunger has a desired fall rate in the well.

DETAILED DESCRIPTION OF THE DISCLOSURE

Figure 1A:
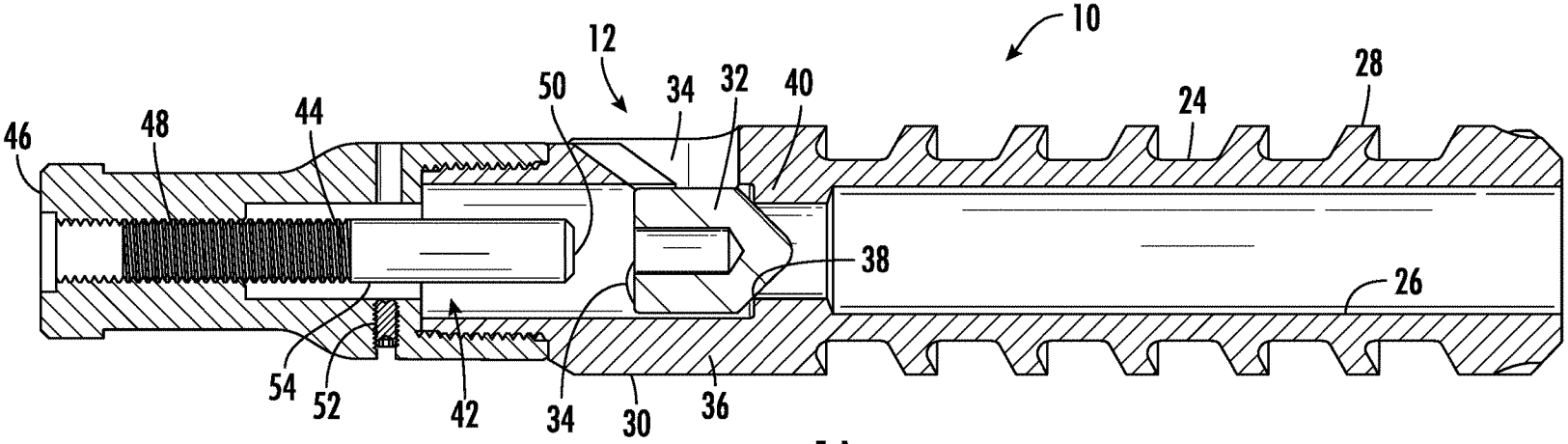
FIGS. 1A-1C are side elevation views of an adjustable plunger in various operating positions constructed in accordance with the present disclosure.

The present disclosure relates to a plunger 10 with a variable flow mechanism 12 that can be adjusted to permit the desired fluid to flow through the plunger 10, which directly affects the fall rate of the plunger 10. The fall rate of the plunger 10 can be set whether in a static or dynamic flow regime. An operator of a well being able to adjust and set the fall rate of the plunger 10 allows the operator to regulate the cycle of frequency of the plunger 10 to align with the outflow performance of a well.

Typically, a hydrocarbon well comprises a production string extending into the earth in communication with a subterranean hydrocarbon bearing formation. The production string is typically a conventional tubing string made up of joints of tubing that are threaded together. Although the production string may be inside a casing string, it is illustrated as cemented in the earth. The formation communicates with the inside of the production string through perforations. The formation communicates with the inside of the production string through perforations. As will be more fully apparent hereinafter, a plunger lift assembly incorporates the plunger 10, in addition to other known components, to lift oil, condensate or water from the bottom of the well which may be classified as either an oil well or a gas well. As will be more fully apparent hereinafter, a plunger lift assembly incorporates the plunger 10, in addition to other known components, to lift oil, condensate or water from the bottom of the well which may be classified as either an oil well or a gas well.

Referring now to FIGS. 1A-3C, the plunger 10 includes a mandrel 24 and a restrictive flow mechanism 12. The mandrel 24 has a passageway 26 disposed therein in fluid communication with the restrictive flow mechanism 12 and an outer engagement portion 28 that engages the inside of the production string to lift fluids uphole in the well. The restrictive flow mechanism 12 includes a hollow body 30 that includes a plug 32 that is slidably disposed in the hollow body 30. The hollow body 30 can have ports 34 disposed therein that are in selective fluid communication with the passageway 26 disposed in the mandrel 24 via the hollow body 30, depending upon the position of the plug 32 in the hollow body 30 of the restrictive flow mechanism 12. The hollow body 30 is smaller in diameter than the mandrel 24 of the plunger 10 to permit fluid outside and below the plunger 10 to more easily flow into and out of the ports 34. The ports 34 in the hollow body 30 can be ultimately radially directed in the side 36 of the hollow body 30. The restrictive flow mechanism 12 can be designed in numerous ways such that the plug 32 can: 1) block the flow of fluid between the passageway 26 of the mandrel 24 and the hollow body 30 when the plunger 10 is in a closed position; 2) permit the maximum flow of fluid through the plunger 10 via the ports 34 and the passageway 26 in the mandrel 24 when the plunger 10 is in a fully opened position; or 3) permit partial flow of fluid through the plunger 10 via the ports 34 and the passageway 26 in the mandrel 24 when the plunger 10 is in a partially opened position.

When the plunger 10 is in the fully closed position, the plunger 10 is positioned in the hollow body 30 as far uphole in the hollow body 30 as possible, which prevents fluid from being able to flow between the ports 34 and the passageway 26 in the mandrel 24. In the closed position, fluid cannot pass between the hollow body 30 to the passageway 26 in the mandrel 24 either. In the fully open position, the plug 32 in the hollow body 30 is moved as far in the downhole direction so that no part of the ports 34 are blocked by the plug 32 and the maximum amount fluid can flow between the ports 34, the hollow body 30 and the passageway 26 in the mandrel 24. In the partially open position, the plug 34 in the hollow body 30 is moved as far in the downhole direction as possible, based on the configuration of the restrictive flow mechanism 12, so that a portion of each port 34 is blocked by the plug 32 and a desired amount of fluid can flow between the ports 34, the hollow body 30 and the passageway 26 in the mandrel 24. The restrictive flow mechanism 12 can be adjusted such that any portion of the ports 34 can be blocked to get any desired amount of fluid flowing through the plunger 10 to cause a desired fall rate of the plunger 10.

The restrictive flow mechanism 12 can include a seat 38 on an uphole part 40 of the hollow body 30 that the plug 32 can engage to prevent the flow of fluid between the ports 34 and the passageway 26 in the mandrel 24. The restrictive flow mechanism 12 can also include a stop mechanism 42 that engages the plug 32 to limit how far in the downhole direction in the hollow body 30 the plug 32 can go. When the plunger 10 is falling in the well, the plug 32 is a fall position and is typically against the stop mechanism 42 allowing fluid to flow through the ports 34 and the passageway 26. When the plunger 10 is being used to lift fluids from the well, the plug 32 is in the lift position and is forced against the seat 38 to prevent fluid from flowing through the plunger 10.

Figure 1B:
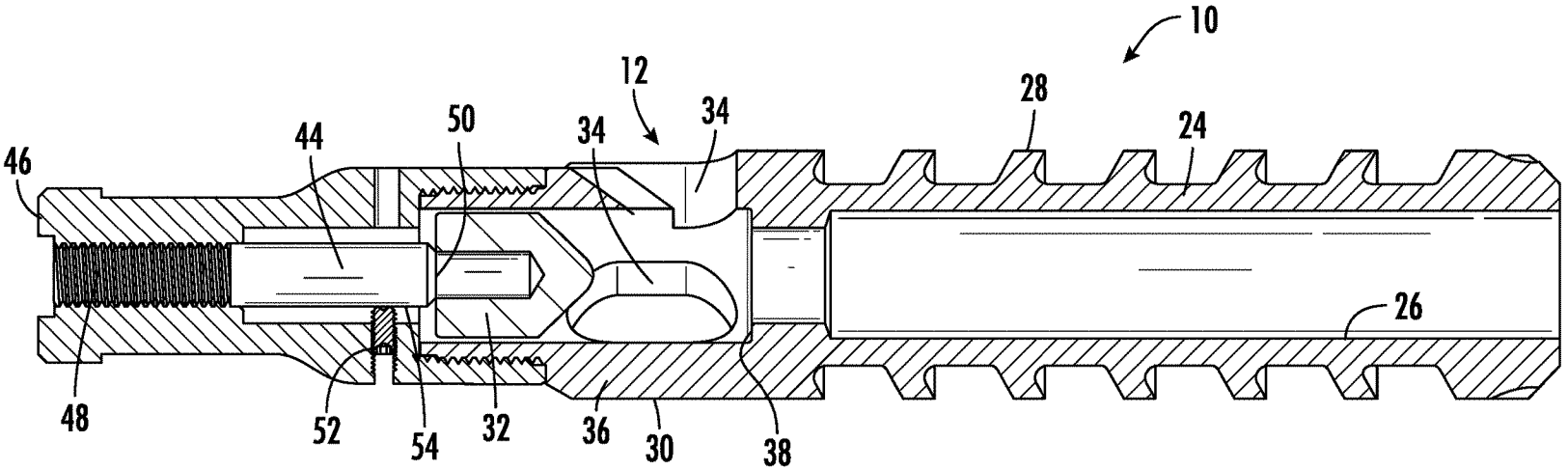
Figure 1C:
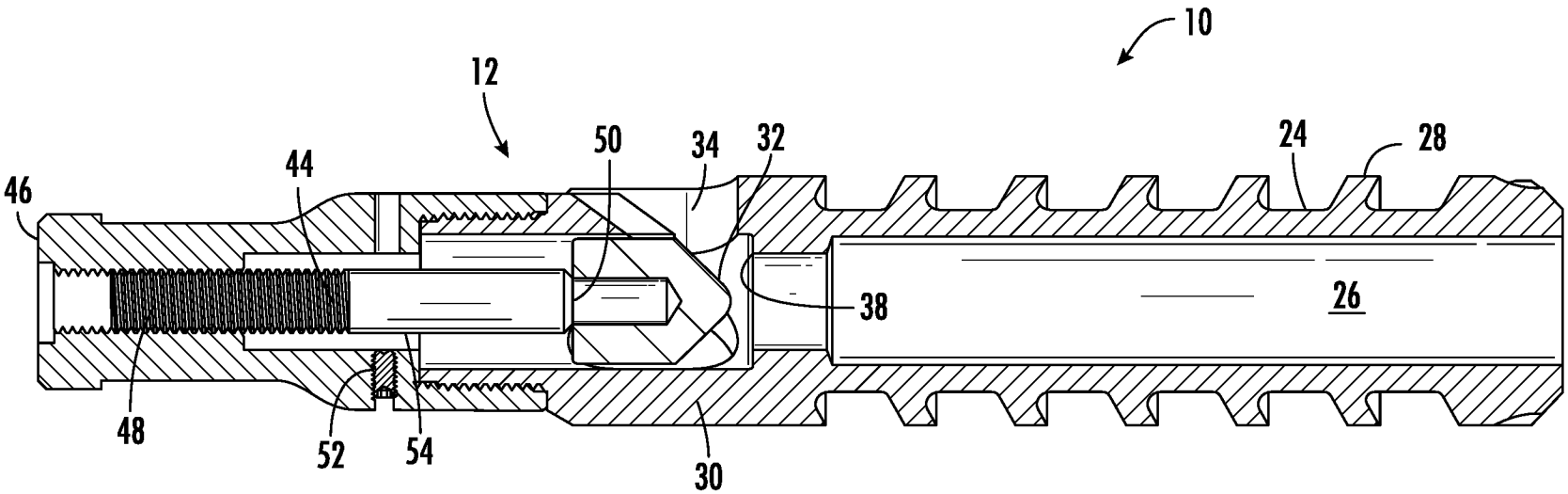

In one embodiment shown in FIGS. 1A-1C, the stop mechanism 42 is adjustable so that the position of the plug 32 in the fall position can be varied to achieve the desired fall rate of the plunger 10. The stop mechanism 42 in this embodiment includes a rod 44 threaded into a downhole end 46 of the plunger 10 on a first end 48 of the rod 44. The second end 50 of the rod 44 extends up into the hollow body 30 to engage the plug 32 when the plug 32 is in the fall position. The position of the second end 50 of the rod 44 in the hollow body 30 can be changed by threading the rod 44 further into or out of the downhole end 46 of the plunger 10. Position of the rod 44 can be maintained by preventing rotation of the rod 44 in the plunger 10. Any device known in the art can be used to prevent rotation of the rod 44 in the plunger 10. In one embodiment, a set screw 52 can be threaded through the downhole end 46 of the plunger 10 to engage the side 54 of the rod 44 to prevent its rotation. The rod 44 can also have a cross-sectional shape that contributes to the prevention of the rod's rotation. For example, the cross-section of the rod could be just about any polygonal shape such as triangle, square, pentagon, hexagon, etc.

Figure 2A:
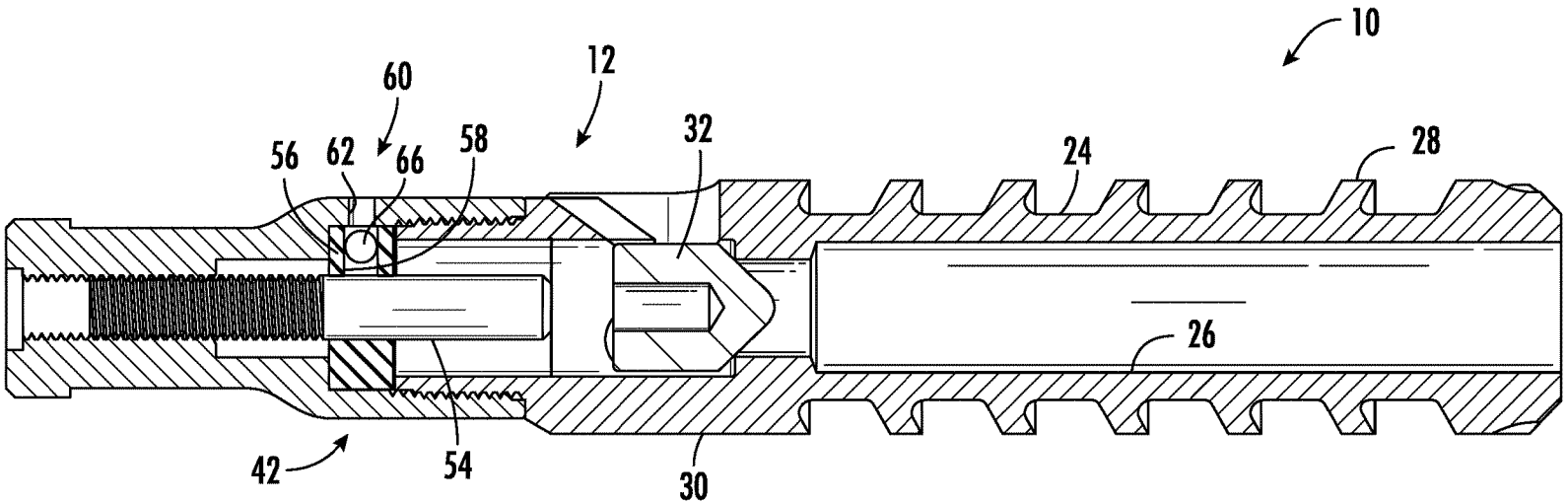
FIGS. 2A-2C are side elevation views of another embodiment of an adjustable plunger in various operating positions constructed in accordance with the present disclosure.
Figure 2B:
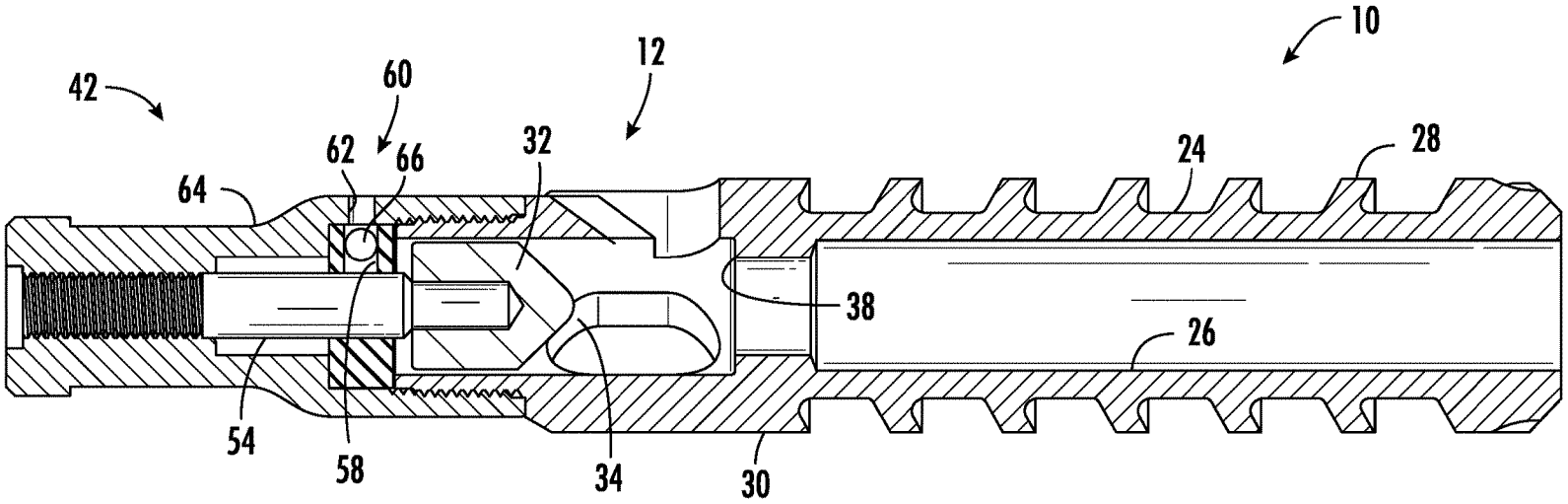
Figure 2C:
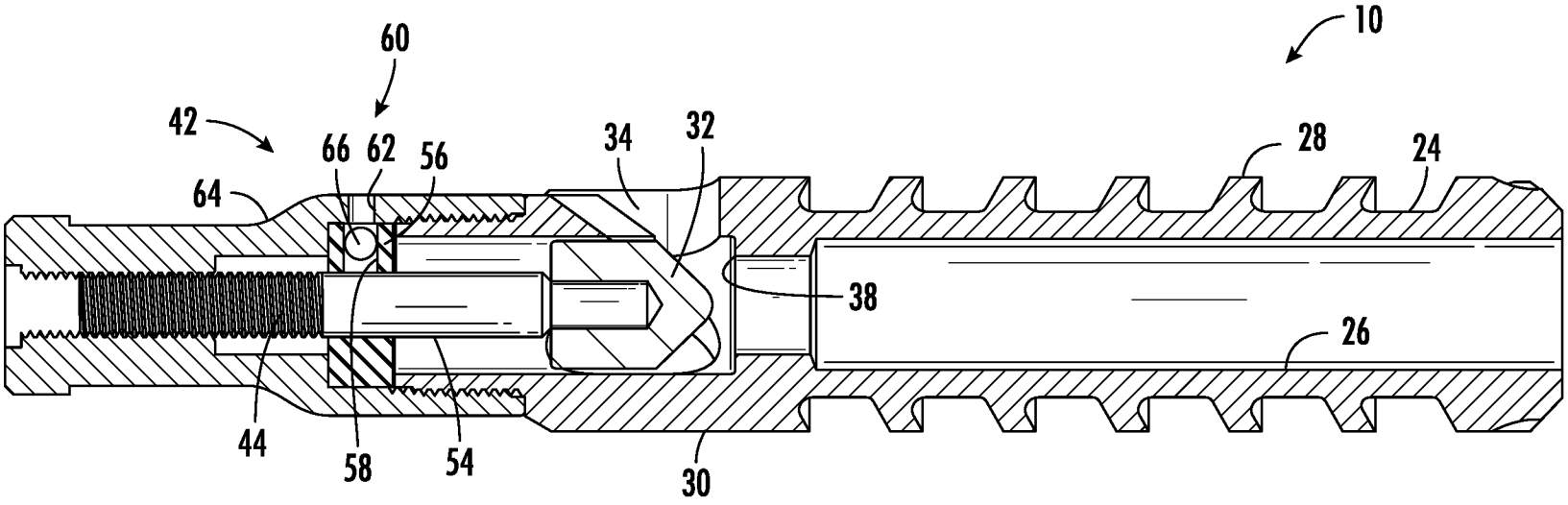

In another embodiment shown in FIGS. 2A-2C, the stop mechanism 42 includes a centralizer component 56 that is disposed in the hollow chamber 30 such that the centralizer 56 cannot move in the axial direction due to mechanical constraints of the plunger 10. The ID of the centralizer 56 is sized and shaped to match and receive the rod 44 to keep the rod 44 centered in the hollow body 30. The centralizer 56 can also include a detent cavity 58 for housing a spring/ball detent system 60. The detent system 60 prevents the centralizer 56 from rotating, which means the rod 44 cannot rotate and axial position of the rod 44 is maintained in the hollow body 30. A small port 62 is disposed in a fishing neck 64 of the plunger 10 which allows the detent ball 66 to be depressed by the operator in the field to allow the centralizer 56 and the rod 44 to rotate and change the axial position of the rod 44 in the hollow body 30. Changing the axial position of the rod 44 changes the amount of fluid that can flow through the plunger 10 and thus, changes the fall rate of the plunger 10.

Figure 3A:
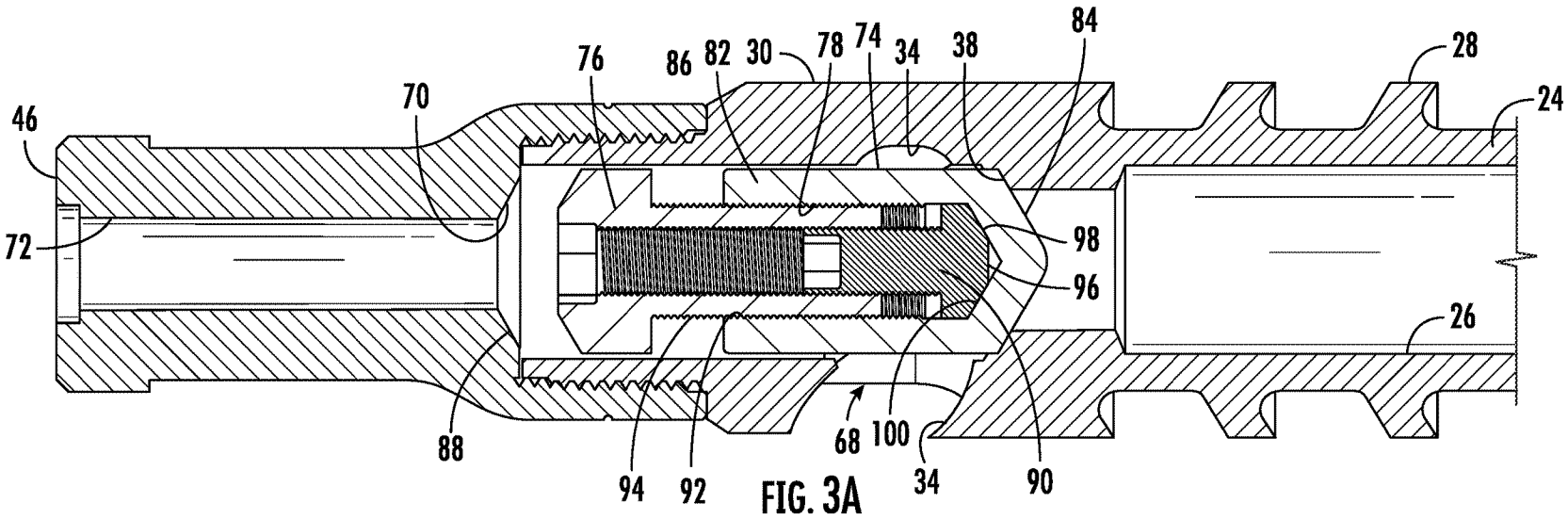
FIGS. 3A-3C are side elevation views of yet another embodiment of an adjustable plunger in various operating positions constructed in accordance with the present disclosure.
Figure 3B:
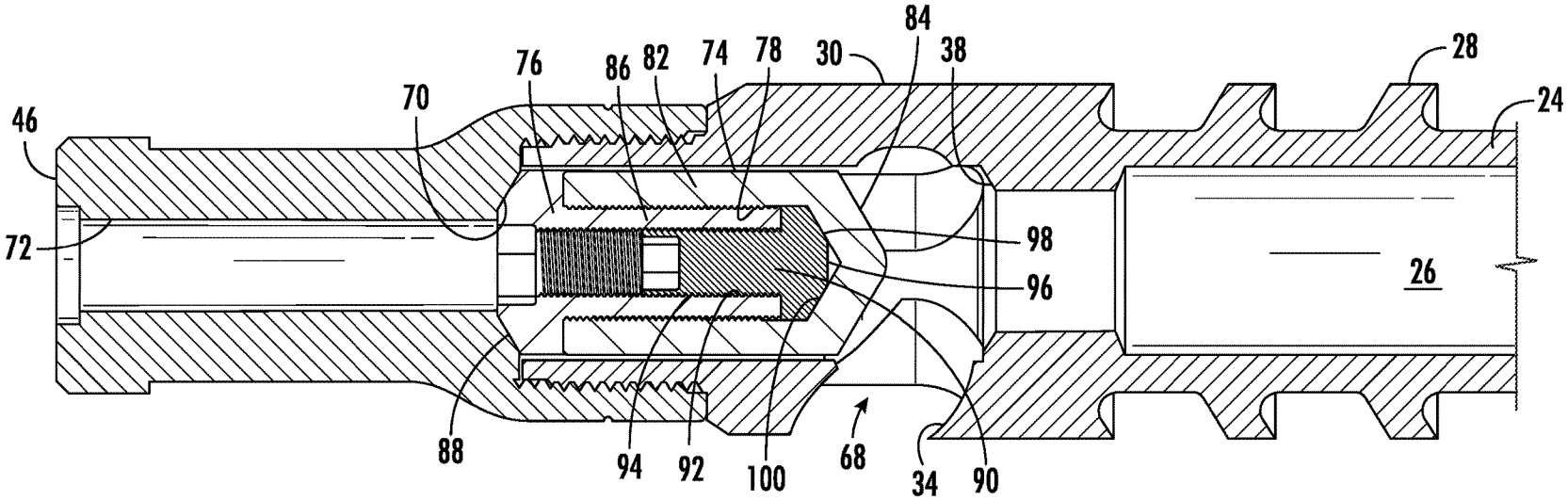
Figure 3C:
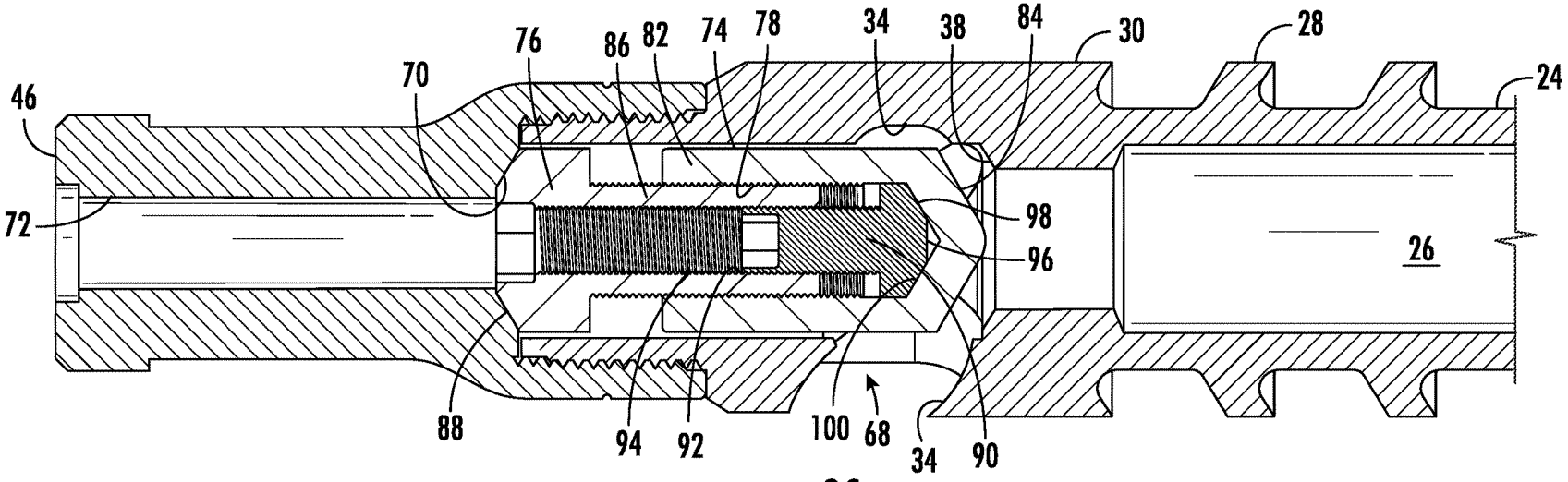
Figure 3D:
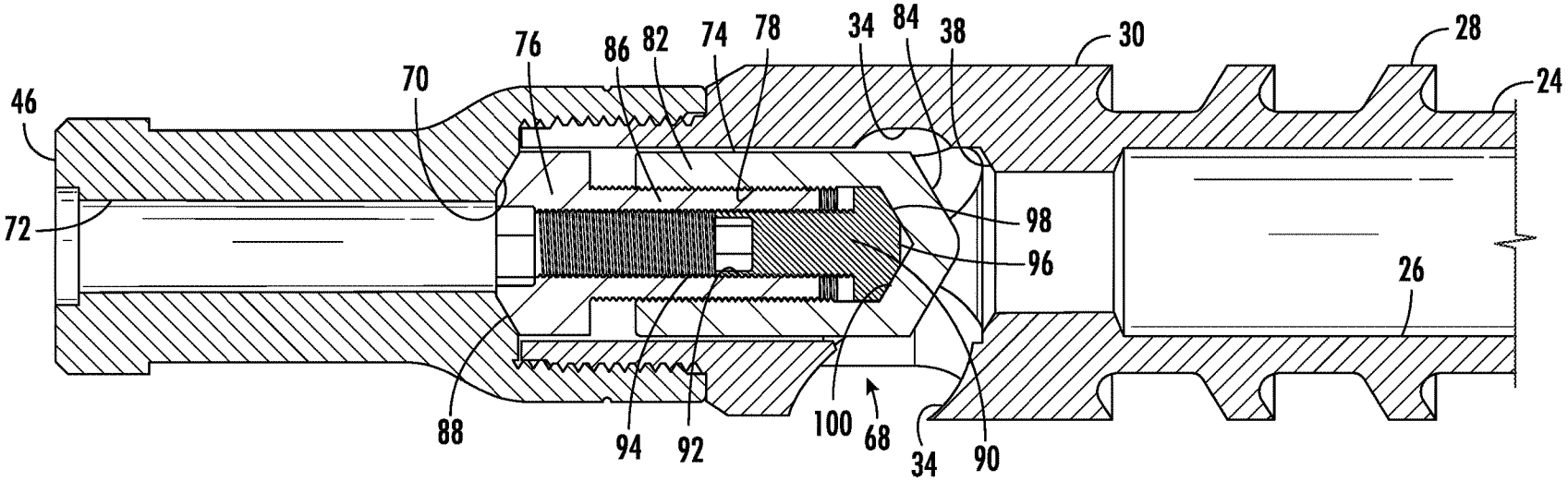

In another embodiment of the present disclosure shown in FIGS. 3A-3C, the plunger 10 can include an adjustable plug 68 where its size can be altered to vary the amount of fluid that can pass through the plunger 10 and adjust the fall rate to a desired rate. Similar to the plug 32 in other embodiments described herein, the adjustable plug 68 engages the seat 38 on the uphole part 40 of the hollow body 30 to prevent the flow of fluid between the ports 34 and the passageway 26 in the mandrel 24. In this embodiment, the hollow body 30 can have a downhole seat 70 that the adjustable plug 68 can engage when the plunger 10 is falling in the well. When the plunger 10 is falling in the well, the size of the adjustable plug 68 determines how much of the ports 34 in the hollow body 30 are blocked, thus affecting the amount/rate of fluid that can flow through the ports 34 and plunger 10. The downhole end 46 of the plunger 10 in this embodiment can include an axial directed port 72 that connects the hollow body 30 to a downhole part of the well.

In one embodiment, the adjustable plug 68 can include multiple parts to create the adjustability desired. The adjustable plug 68 can include a primary plug head 74 (or primary plug components) to engage the uphole seat 38 and is threadably engaged with a secondary plug component 76 that can engage the downhole seat 70 when the plunger 10 is in the fall position. The primary plug head 74 can be threaded onto the secondary plug component 76 to create any desired size for the adjustable plug 68. The primary plug head 74 can have threads 78 disposed on an internal side of a sleeve 82 that extends from a head portion 84. The secondary plug component 76 can have a threaded stem 86 that extends from a head component 88 that is threaded into the sleeve 82 of the primary plug component 74.

In a further embodiment of the present disclosure, the adjustable plug 68 can include a locking device 90 that is threaded into a threaded opening 92 of the stem 86 of the secondary plug component 76. The locking device 90 can have a threaded rod 94 member that extends from a head member 96 that is threaded into the threaded opening 92 of the stem 86 of the secondary plug component 76. The extent that the locking device 90 is threaded into the secondary plug component 76 determines the size of the plug 68 for a desired fall rate. Once the locking device 90 is threaded into the secondary plug component 76 to the desired extent, the primary plug head 74 is threaded onto the secondary plug component 76 until the primary plug head 74 engages the head member 96 of the locking device 90. The engagement forces the locking device 90 to be securely engaged with the secondary plug component 76 and prevent rotation of the locking device 90 relative to the secondary plug component 76. An external side 98 of the head member 96 of the locking device 90 engages an internal side 100 of the head portion 84 of the primary plug head 74.

To adjust the size of the adjustable plug 68, the primary plug head 74 is removed from the secondary plug component 67 and the locking device 90 is rotated to increase or decrease the size of the adjustable plug 68. Once the locking device 90 is moved to its desired position with respect to the secondary plug component 76, the primary plug head 74 is threaded back onto the secondary plug component 76 to create the adjustable plug 68. It should be understood and appreciated that the adjustable plug 68 can be created with any components and in any manner known in the art such that the plug size can be adjusted and the plunger 10 have the desired fall rate. It should be understood and appreciated that the locking device 90 could be secured between the engagement of the primary plug head 74 and the secondary plug component 76 in any manner desirable such that the size of the adjustable plug 68 is secured.

The present disclosure is also directed to a method of incorporating any of the adjustable plungers described herein in oil and gas operations. For example, the plungers described herein can be used to lift fluids from oil and gas wells. The method can include employing the adjustable plunger 10 in a well and collecting oil and gas fluids from therefrom. The method can also include designing and/or adjusting/manipulating the plunger 10 to have a desired fall rate during the oil and gas operations the plunger 10 is used in.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A plunger for use in an oil or gas well, the plunger comprising:

a mandrel;

a hollow body with radial directed ports disposed therein;

a variable flow mechanism that can be adjusted to achieve a fall rate for the plunger for a particular oil and gas operation;

an adjustable plug slidably disposed within the hollow body, the plug having a first position in the hollow body when the plunger is descending in the well and a second position in the hollow body when the plunger is ascending in the well, the adjustable plug blocking the flow of fluid through the radial directed ports when the adjustable plug is in the second position; and wherein the adjustable plug includes a primary plug component that engages a first seat in an uphole part of the hollow body when the adjustable plug is in the second position and a secondary plug component adjustably supported by the first plug component such that the size of the adjustable plug can be altered.

2. The plunger of claim 1 wherein the secondary plug component is threadably engaged with the primary plug component.

3. The plunger of claim 1 wherein the adjustable plug includes a locking device that engages the primary plug component and the secondary plug component to lock-in the size of the adjustable plug.

4. The plunger of claim 3 wherein the locking device is threadably secured to the secondary plug component.

5. A method of lifting fluids from an oil and gas well, the method comprising:

employing an adjustable plunger to lift fluids from the oil and gas well wherein the adjustable plunger has a desired fall rate in the well, the adjustable plunger comprising:

a mandrel;

a hollow body with radial directed ports disposed therein;

a variable flow mechanism that can be adjusted to achieve a fall rate for the plunger for a particular oil and gas operation;

an adjustable plug slidably disposed within the hollow body, the plug having a first position in the hollow body when the plunger is descending in the well and a second position in the hollow body when the plunger is ascending in the well, the adjustable plug blocking the flow of fluid through the radial directed ports when the adjustable plug is in the second position; and wherein the adjustable plug includes a primary plug component that engages a first seat in an uphole part of the hollow body when the adjustable plug is in the second position and a secondary plug component adjustably supported by the first plug component such that the size of the adjustable plug can be altered.

6. The method of claim 5 further comprising manipulating the adjustable plunger to alter the fall rate of the adjustable plunger in the well.

7. The method of claim 5 wherein secondary plug component is threadably engaged with the primary plug component.

8. The method of claim 5 wherein the adjustable plug includes a locking device that engages the primary plug component and the secondary plug component to lock-in the size of the adjustable plug.

9. The method of claim 8 wherein the locking device is threadably secured to the secondary plug component.

* * * * *